United States Patent [19]

Jankovsky et al.

[11] Patent Number: 4,653,547

[45] Date of Patent: Mar. 31, 1987

[54] GUIDE FOR PARTS OF A WEAVING MACHINE

[75] Inventors: Frantisek Jankovsky, Winterthur; Lorant Gacsay, Zurich, both of Switzerland

[73] Assignee: Sulzer Brothers Limited, Winterthur, Switzerland

[21] Appl. No.: 702,665

[22] Filed: Feb. 19, 1985

[30] Foreign Application Priority Data

Feb. 17, 1984 [CH] Switzerland ..... 769/84

[51] Int. Cl.[4] ..... D03D 47/24; D03D 49/26; F16C 29/02

[52] U.S. Cl. ..... 139/439; 139/449; 384/42

[58] Field of Search ..... 139/437–439, 139/185, 449, 142, 145; 308/3 R; 384/42

[56] References Cited

U.S. PATENT DOCUMENTS

| | | | |
|---|---|---|---|
| 1,945,996 | 2/1934 | Rossmann | 139/142 |
| 2,125,094 | 8/1938 | Dewas | 139/449 |
| 3,360,306 | 12/1967 | Vargady | 308/3 R |
| 3,445,143 | 5/1969 | Swenson | 308/3 R |
| 3,720,449 | 3/1973 | Godin | 308/3 R |
| 4,040,453 | 8/1977 | Juillard et al. | 139/449 X |
| 4,114,945 | 9/1978 | Lutz | 308/3 R |
| 4,415,010 | 11/1983 | Schmitz | 139/439 |
| 4,497,347 | 2/1985 | Kiwior et al. | 139/449 |
| 4,544,212 | 10/1985 | Parzefall et al. | 308/3 R |

FOREIGN PATENT DOCUMENTS

| | | | |
|---|---|---|---|
| 313155 | 5/1956 | Switzerland | 139/145 |
| 636655 | 6/1983 | Switzerland | 139/439 |
| 723333 | 6/1955 | United Kingdom | 139/145 |

*Primary Examiner*—James Kee Chi

*Attorney, Agent, or Firm*—Kenyon & Kenyon

[57] ABSTRACT

The guide is used for parts moved as if by a shear force of a weaving machine, particularly a projectile weaving machine. The guide has a body which is reciprocably mounted relative to at least one guideway. In addition, at least one guide element is associated with the body and is movable transversely of the guideway during imposition of an eccentric loading on the body which causes the body to turn within the guideway about the axis of the guideway.

13 Claims, 24 Drawing Figures

GUIDE FOR PARTS OF A WEAVING MACHINE

This invention relates to a guide. More particularly, this invention relates to a guide for guiding parts in a weaving machine.

As is known, various types of guides have been provided in weaving machines for guiding parts which are moved as if by a shear force, particularly, in a projectile weaving machine. For example, Swiss Patent Nos. 313,155 and 636,655 as well as U.S. Pat. No. 4,415,010 describe various types of guides which have been used. Such guides serve to guide a rigid body which is reciprocable relative to a guide groove or guide rail wherein the rigid body experiences a substantially eccentric actuation. In such cases, the rigid body tends, when actuated, to take up a tilted position within the guide groove or on the guide rail so that an edge contact, or, in an extreme case, a point contact, with "seizing-up" occurs between the guide surfaces. This results in an elevated surface pressure and heavy wear since the surface pressure which occur are too high to permit of proper lubricant film formation.

Accordingly, it is an object of the invention to improve the guiding of a body which is eccentrically actuated so that tilting is obviated.

It is another object of the invention to provide a guide wherein a reciprocable body can be guided on and between parallel surfaces between which a uniform lubricating film can be maintained.

It is another object of the invention to provide a guide for a weaving machine in which a slidably mounted body can be eccentrically loaded without creating an edge contact with a guide surface.

Briefly, the invention provides a guide which is comprised of at least one guideway, a body which is reciprocally mounted in a guideway for longitudinal movement and at least one guide element on the body which is disposed within the guideway to permit movement of one of the body and the element transversely of the guideway. Thus, upon an eccentric acutation of the body, the guide element may remain in parallel with the guideway so that between-surfaces sliding is optimal.

In order to provide for a transverse movement, one of the body and the guide element is made to be resiliently deformable transversely of the guideway. This permits the body and the guide element to be manufactured very easily as an integral member.

In one embodiment, the reciprocable body may be constructed with two integral guide elements which are mounted thereon in perpendicular planes to each other with each guide element being resiliently deformable relative to the body. This construction permits a very large guide area and, therefore, leads to a correspondingly increased surface pressure between the guide elements and the guideway. Furthermore, the guide elements can be associated with separate guideways. This enables stable guidence to be provided despite very substantial eccentric forces.

In another embodiment, the guide elements may be mounted on the reciprocable body in a pivotal manner. This construction imparts very great mobility to the guide elements.

In still another embodiment, the guide elements may be in the form of a slide block which is removably mounted on the reciprocable body. This permits the slide blocks to be interchanged from time to time so that the body itself does not have to be replaced when wear occurs.

In still another embodiment, use may be made of a ball joint to mount each guide element on the reciprocable body. Also, use may be made of a spherical ball to mount the guide element on the reciprocable body. Either feature permits the guide element to be movable in all directions relative to the body under an eccentric loading. In the case where spherical balls are used, a very economic construction can be produced.

In still another embodiment, a guide rail may be disposed within and along the guideway in spaced transverse relation so as to receive the guide element in reciprocable manner. This permits the guide elements to be rigidly mounted on the body without need for a resiliently deformable connection between the guide element and the body.

In still another embodiment, the guide elements may be in the form of sliding shoes which are detachably mounted on the body. This permits a very simole and rapid replacement of a guide element in the case of wear.

In still another embodiment, the guide may be comprised of a rail while a guide element is mounted on and along the rail with a body reciprocally mounted on the guide element for longitudinal movement relative to the rail. In this case, at least one of the guide element and the body is resiliently deformable transversely of the rail. For example, the guide element may be provided with reduced sections adjacent to the rail in order to render the guide element resiliently deformable transversely of the rail. Alternatively, the body may have a pair of arms about the guide element with each arm having a reduced section so as to render the body resiliently deformable transversely of the rail.

These and other objects and advantages of the invention will become more apparent from the following detailed description taken in conjunction with the accompanying drawings wherein:

FIG. 1 illustrates a guide constructed in accordance with the invention in a picking means in a projectile weaving machine;

FIG. 1*a* illustrates a modified guide for a projectile receiving means in a projectile weaving machine;

Figure 1:
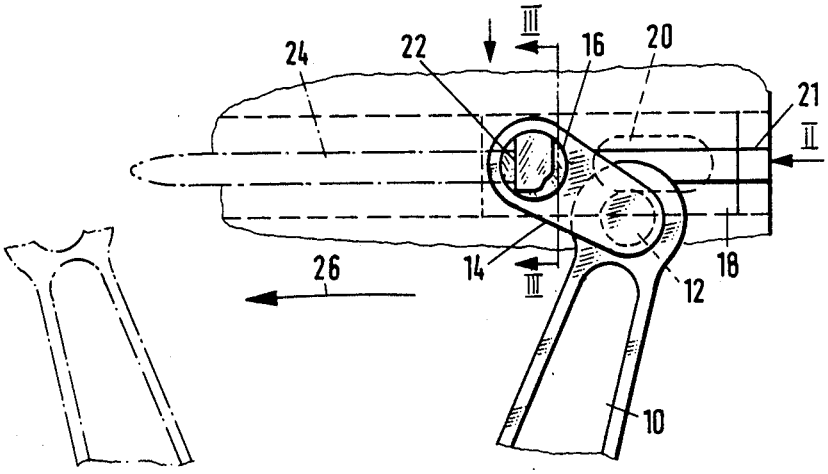
Figure 1A:
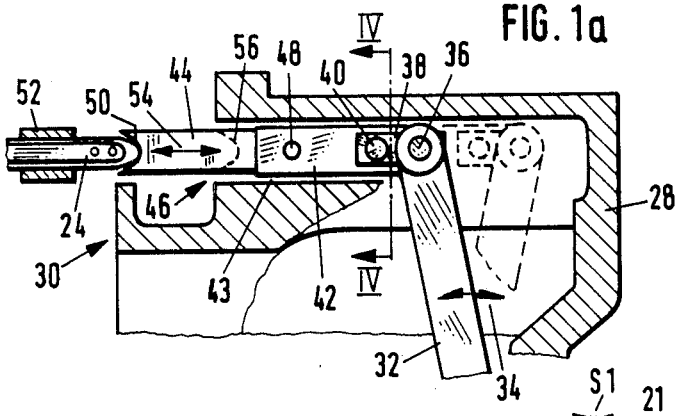
Figure 3:
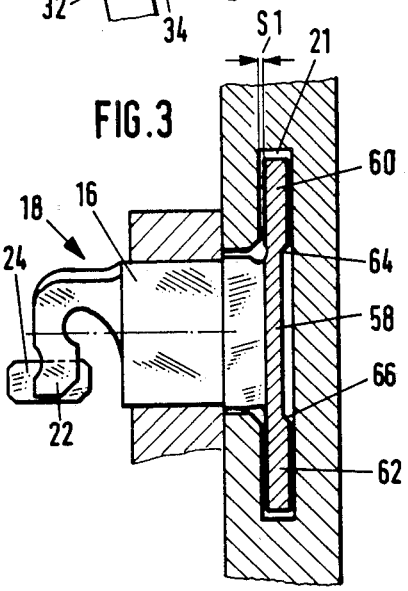
FIG. 3 illustrates a view taken on line III—III of FIG. 1.
Figure 3A:
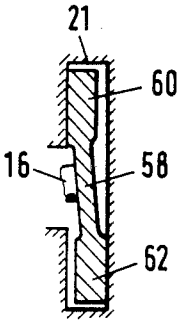
Figure 3B:
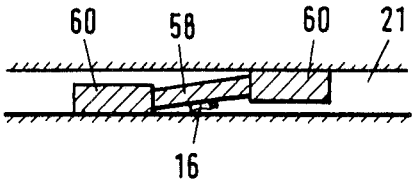
Figure 4:
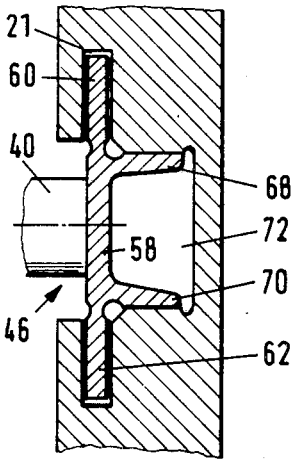

FIG. 3*a* diagrammatically illustrates a guide body under eccentric loading in a transverse plane;

FIG. 3*b* diagrammatically illustrates a cross-sectional view of the guide body of FIG. 3*a* in a perpendicular plane;

FIG. 4 illustrates a view taken on line IV—IV of FIG. 1*a;*

Figure 4A:
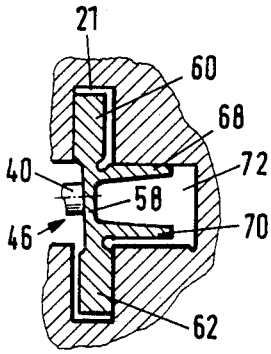
Figure 5:
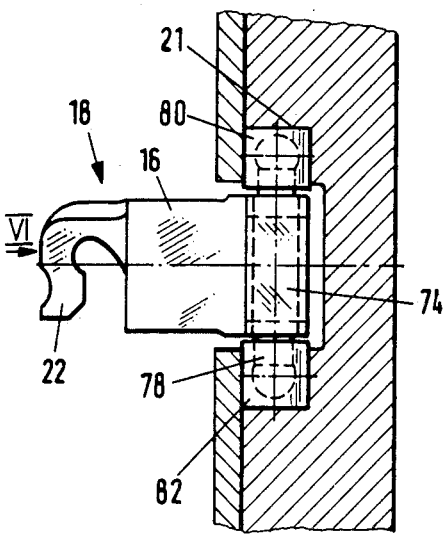
Figure 6:
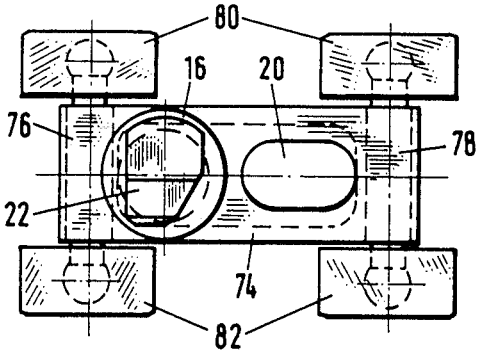
Figure 6A:
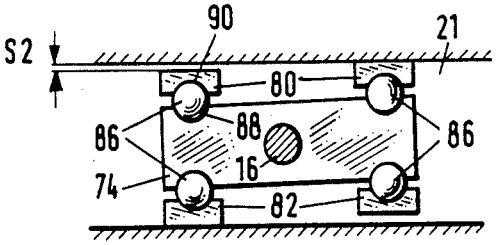
Figure 6B:
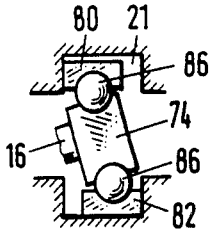

FIG. 4*a* diagrammatically illustrates the guide body of FIG. 4 in an eccentrically loaded condition in accordance with the invention;

FIG. 5 illustrates a modified guide utilizing ball joints in accordance with the invention;

FIG. 6 illustrates a view taken in the direction indicated by the arrow VI of FIG. 5;

FIG. 6*a* diagrammatically illustrates a modified guide employing spherical balls;

FIG. 6*b* illustrates an end view of the guide of FIG. 6*a;*

Figure 6C:
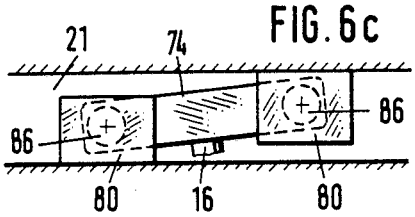

FIG. 6*c* illustrates a top view of the guide of FIG. 6*a;*

Figure 7:
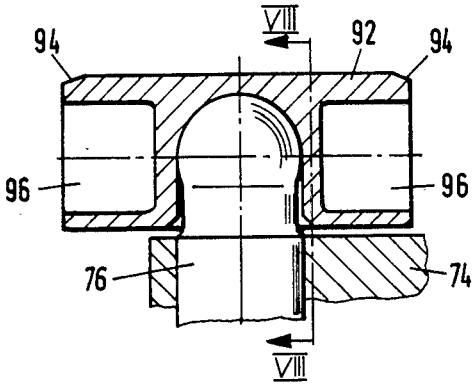
Figure 8:
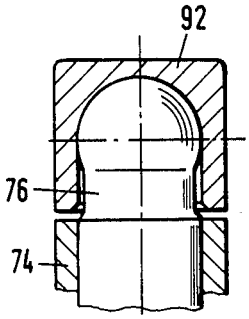
Figure 10:
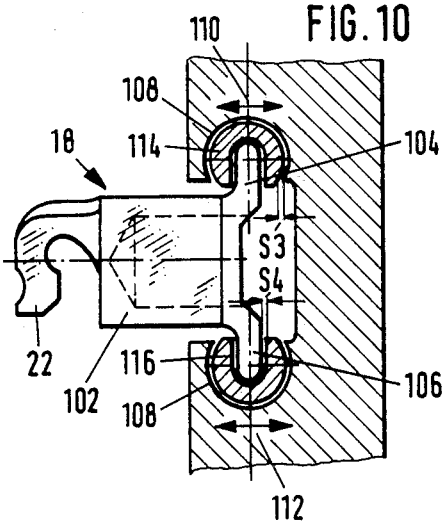
Figure 9:
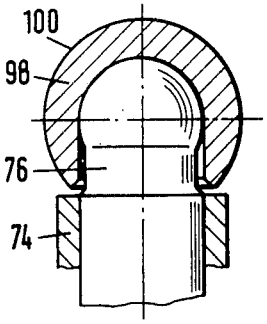
Figure 11:
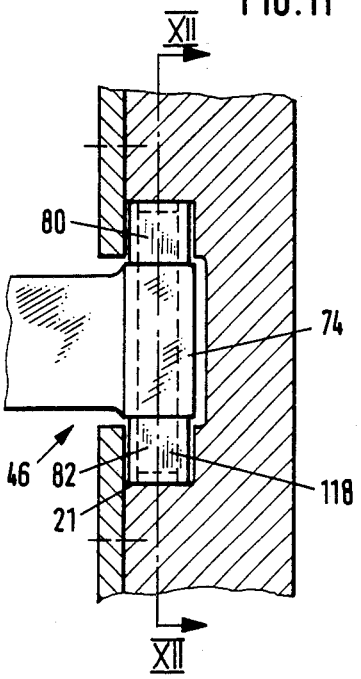
Figure 12:
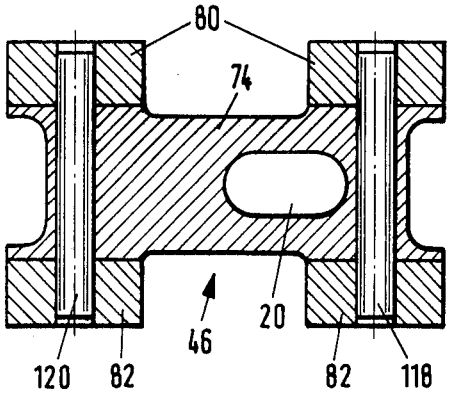
Figure 13:
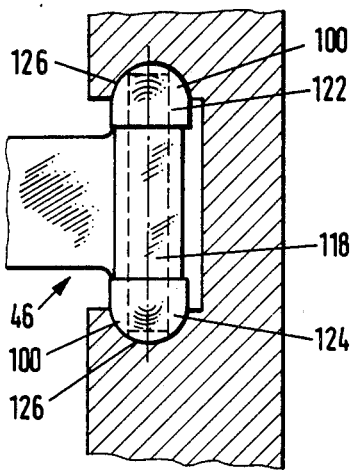
Figure 14:
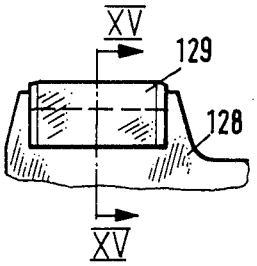
Figure 15:
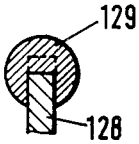
Figure 16:
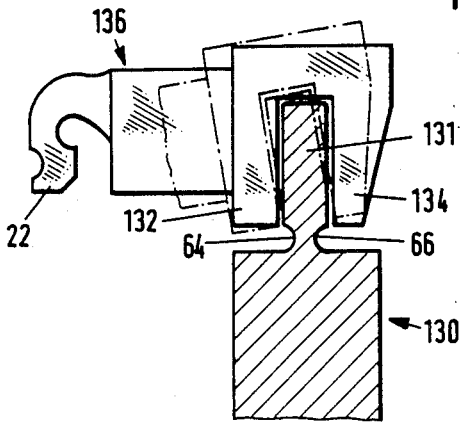
Figure 17:
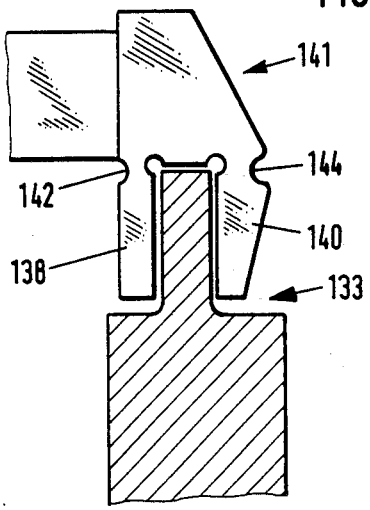

FIG. 7 illustrates a slide block employed as a guide element in accordance with the invention;

FIG. 8 illustrates a view taken on line VIII—VIII of FIG. 7;

FIG. 9 illustrates a modified slide block in accordance with the invention;

FIG. 10 illustrates a modified guide employing a guide rail within a guideway in accordance with the invention;

FIG. 11 illustrates a cross-sectional view of a guide employing pivotally mounted guide elements;

FIG. 12 illustrates a view taken on line XII—XII of FIG. 11;

FIG. 13 illustrates a modified guide employing curved slide blocks in accordance with the invention;

FIG. 14 illustrates a partial view of a guide employing a removably mounted sliding shoe in accordance with the invention;

FIG. 15 illustrates a view taken on line XV—XV of FIG. 14;

FIG. 16 illustrates a modified guide having a rail on which a guide element is resiliently mounted in accordance with the invention; and FIG. 17 illustrates a modified guide having a guide element rigidly mounted on a rail and a body with resiliently deformable arms about the guide element.

Referring to FIG. 1, a picking lever 10 of a striking or picking means for the projectile of a projectile weaving machine is pivotally connected bv way of a pivot 12, link 14 and pin 16 to a picking or striking element 18 which is formed with a weight-reducing aperture 20.

Referring to FIG. 3, the pin 16 carries a prolongation in the form of a stop 22 for abutting a projectile 24. During operation of the weaving machine, a striking mechanism (not shown) pivots the lever 10 in the direction indicated by the arrow 26 in FIG. 1 into the illustrated chain-end position. During this time, the projectile 24 is driven and accelerated across the shed (not shown) of the weaving machine to a suitable receiving means on the other side of the shed.

Referring to FIGS. 1 and 3, during movement of the picking lever 10, the picking element 18 is guided along the guide in the direction of the projectile. To this end, the guide includes a guideway 21 having longitudinal parallel surfaces while the picking eIement carries a rigid body 58 which is slidably mounted in the guideway 21 for longitudinal movement therealong. In addition, the guide includes a pair of guide elements 60, 62 which are mounted on the body 58 in integral manner. These guide elements are disposed within the guideway 21 and have parallel sliding surfaces opposite parallel sliding surfaces of the guideway 21. As indicated in FIG. 3, each guide element 60,62 is connected to the body 58 via a reduced section or profiled zone 64,66, respectively whereby each guide element is resiliently deformable transversely of the guideway 21.

Referring to FIGS. 3*a* and 3*b*, when an eccentric load is placed on the body 58, the body tends to rotate about the rotational axes X and Y (see FIG. 2) so that a deformation occurs in each of these planes. Of note, the amount of deformation is drawn in an exaggerated scale in each of FIGS. 3*a* and 3*b*. Initially, the clearance S1 between the guide elements 60, 62 and the adjacent slide surface of the guideway 21 is approximately 0.2 millimeters.

As indicated in FIG. 3, as the body 58 moves along the guideway 21 under the eccentrically aoplied load, the guide elements 60,62 move transversely within the guideway 21 to abut and slide along the surfaces of the guideway 21 in parallel relationship. Thus, a lubricant film can be maintained between the guide elements 60,62 and the guideway 21.

Of note, the guide may be constructed so that the body is connected with a suitable means which projects transversely from the guideway for imposition of a load thereon eccentric to the guideway. Likewise, the guide element or guide elements may be connected to the body in any resiliently deformable relation in order to permit the body to turn relative to the guideway under a load imposed on the projecting means while the guide element remains in oarallel with the guideway surfaces.

For example, referring to FIG. 1*a*, the guide may be incorporated in a gripper projectile receiving means of the weaving machine. In this case, a restoring lever 32 of a catcher 30 of the receiving means is mounted in a casing 28 and is pivotally mounted in a reciprocating manner as indicated by the arrow 34 by any conventional means (not shown). As indicated, the receiving means includes a projectile restorer 46 which is composed of a body 42 and a striking part 44 secured to the lever 32 by way of a pivot pin 36, link 38 and pin 40. In this case, the striking part 44 is secured to the body 42 by a rivet 48.

The part 44 acts by way of a struck end surface 50 on the projectile 24 which is subsequently braked by a catcher brake 52.

The body 42 is slidably mounted in a guideway which is in the form of a groove 43.

During operation, the restorer 46 with the body 42 moves, as indicated by the arrow 54, between a front position as illustrated and a rear position 56 as indicated by chain lines. During braking, the projectile 24 may move as far as the rear position 56 depending upon the braking effect.

Referring to FIG. 4, wherein like reference characters indicate like parts as above, the guide for the restorer 46 includes a guideway 21, a rigid body 58 connected to the pin 40 and pairs of guide elements 60,62; 68,70 which are mounted on the body 58 in perpendicular planes to each other. As indicated, the guide elements 68,70 are disposed in a separate guide groove or guideway 72.

Figure 2:
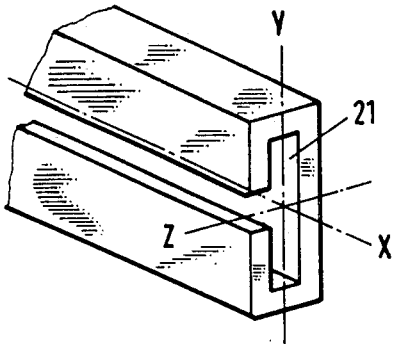
FIG. 2 illustrates a perspective view to an enlarged scale of a guideway employed in the construction of FIG. 1.

Referring to FIG. 4*a* in operation, should the body 58 rotate about the axis X of FIG. 2, the guide elements 68, 70 provide additional stabilization and increase the contact areas and, therefore, reduce surface friction in the lubricating film Referring to FIGS. 5 and 6, wherein like reference characters indicate like parts as above, the elongated body 74 may be provided with axles 76, 78 at the forward and rear ends with each axle 76,78 having ball joints at each end on which guide elements in the form of slide blocks 80,82 are respectively pivotally mounted.

Referring to FIG. 5, during eccentric loading of the pin 16, the body 74 may turn about the horizontal axis X (see FIG. 2) as well as about the vertical axis Y of FIG. 2 so that the slide blocks 80,82 move transversely within the guideway 21. Of note, the clearance for the guide blocks 80, 82 is not shown in FIG. 5.

Referring to FIGS. 6*a*, 6*b* and 6*c* wherein like reference characters indicate like oarts as above, the slide blocks 80,82 may be mounted by way of spherical balls 86 on the body 74. To this end, the body 74 is provided with suitable recesses 88 to receive the balls 86 while the slide blocks 80,82 are provided with recesses 90 to receive the spherical balls 86.

As indicated in FIG. 6*a*, the clearance S2 between the forward upper slide block 80 and the opposed surface of the guideway 21 is approximately 0.2 millimeters.

Referring to FIGS. 7 and 8, wherein like reference characters indicate like parts as above, each slide block 92 may be provided with shoulders or chamfers 94 to improve their sliding properties. In addition, each slide block may be formed with weight-reducing recesses 96 in order to reduce the moments of inertia while further improving the mobility of the slide block.

Referring to FIG. 9, wherein like reference characters indicate like parts as above, the slide block 98 may have a cylindrical generated surface 100 to further imorove sliding properties.

Referring to FIGS. 7, 8 and 9, each slide block 92, 98 is removably mounted on the axle 76 in order to be readily replaceable should undue wear occur.

Referring to FIG. 10, wherein like reference characters indicate like parts as above, the picking element 18 may carry a body 102 which carries rigid guide elements 104, 106. In addition, a pair of plastic guide rails 114, 116 are disposed within and along grooves 108 in the guideway. As indicated, each plastic rail 114, 116 is movable transversely as indicated by the arrows 110, 112 by virtue of a clearance S3 therebetween. This clearance is approximately 0.3 millimeters. In addition, each rigid guide element 104, 106 is movable transversely in the direction of the arrows 110, 112 relative to the respective guide rails 114, 116 by virtue of a clearance S4. This clearance is approximately 0.2 millimeters.

Referring to FIGS. 11 and 12, wherein like reference characters indicate like parts as above, the restorer 46 is connected with a body 74 on which slide blocks 80, 82 are pivotally mounted by way of cylindrical pins 118, 120 at the forward and rear ends of the body 74. However, in this construction, the slide blocks 80, 82 are movable only in the manner indicated in FIG. 6*c*.

Referring to FIG. 13, wherein like reference characters indicate like parts as above, the slide blocks 122, 124 which are mounted on the restorer 46 may have a cylindrical surface similar to that indicated in FIG. 9. In addition, the grooves 126 of the guideway may have similar guide surfaces to receive the cylindrical surfaces of the slide blocks 122.

Referring to FIGS. 14 and 15, the guide elements on a body 128 may take the form of plastic or metal push-on sliding shoes 129 which can be easily replaced when worn.

Referring to FIG. 16, the guide may be constructed in the form of a rail 130 on which a guide element 131 is mounted therealong. In addition, a picking element 36 which carries a projection 22, as above is mounted by way of a body having depending arms 132, 134, as viewed, about the guide element 131. In this case, the guide element 131 is integrally connected with the rail 130 via reduced sections 64, 66 adjacent the rail 130 in order to render the guide element 131 resiliently deformable transversely of the rail 130. Thus, the guide element 131 can move transversely with the picking element 136, for instance, into the position shown in chain-dotted lines under an eccentric loading of the picking element 136.

Referring to FIG. 17, the guide may also be constructed with a rail 133 having an upstanding portion while a body 141 having depending arms 138, 140 enveloos the upstanding rail portion. In this case, the arms 138, 140 serve as guide elements and are connected with the body 141 via reduced sections 142, 144 so as to be resiliently deformable transversely of the axis of the rail 133.

Of note, the constructions previously described in which slide blocks are movable in guide grooves can be incorporated into the rail type construction shown in FIGS. 16 and 17.

The invention thus provides a guide of relatively simple construction wherein eccentric loadings can be imposed on a slidable member without creating edge or point contacts between the guided member and the surfaces of a guideway.

What is claimed is:

1. A guide comprising at least one guideway;

a body reciprocally mounted in said guideway for longitudinal movement therein; and at least one elastically deformable guide element on said body and disposed within said guideway with a clearance therebetween to permit movement of said body and said element transversely of said guideway, said guide element being resiliently deformable transversely of said guideway to permit said body to turn relative to said guideway under an eccentrically applied load on said body.

2. A guide as set forth in claim 1 wherein at least two guide elements are mounted on said body in perpendicular planes to each other.

3. A guide as set forth in claim 2 which comprises a pair of guideways, each said guideway receiving a respective guide element therein.

4. A guide as set forth in claim 1 which further comprises a guide rail disposed within and along said guideway in spaced transverse relation, said guide rail receiving said guide element therein.

5. A guide comprising a rail;

a guide element mounted on and along said rail with a clearance therebetween; and a body mounted on said guide element with a clearance therebetween for longitudinal movement thereon relative to said rail, said guide element being resiliently deformable transversely of said rail.

6. A guide as set forth in claim 5 wherein said guide element has reduced sections adjacent said rail to render said guide element resiliently deformable transversely of said rail.

7. A guide as set forth in claim 5 wherein said body has a pair of arms about said guide element, each said arm having a reduced section to render said body resiliently deformable transversely of said rail.

8. In a weaving machine having means for picking and means for receiving a gripper projectile;

a guideway;

a body reciprocally mounted in said guideway for longitudinal movement thereon, said body projecting transversely from said guideway to about a gripper projectile; and at least one elastically deformable guide element on said body and disposed within said guideway with a clearance therebetween to permit movement of said body and said element transversely of said guideway whereby said guide element is able to move along said guideway in parallel relation while said body abuts and moves with the gripper projectile in a tilted position.

9. A guide comprising a guideway having longitudinal parallel surfaces;

a body slidably mounted in said guideway for longitudinal movement therealong, said body having means projecting transversely from said guideway for imposition of a load thereon eccentric to said guideway; and at least one guide element mounted on said body and disposed between and in parallel to said surfaces of said guideway with a clearance therebetween, said guide element being connected with said body in transversely resiliently deformable relation to permit said body to turn relative to said guideway under a load imposed on said means while said guide element remains in parallel with said guideway surfaces.

10. A guide as set forth in claim 9 which further comprises a rail extending within and along said guideway and slidably receiving said guide element therein.

11. A guide as set forth in claim 10 wherein said rail is transversely spaced from at least one of said walls of said guideway.

12. A guide as set forth in claim 9 which comprises a pair of said guide elements extending from said body in opposite directions.

13. A guide as set forth in claim 11 wherein said guide element is transversely spaced from said rail.

* * * * *

UNITED STATES PATENT AND TRADEMARK OFFICE

CERTIFICATE OF CORRECTION

PATENT NO. : 4,653,547

DATED : March 31, 1987

INVENTOR(S) : Jankovsky

It is certified that error appears in the above—identified patent and that said Letters Patent is hereby corrected as shown below:

Column 2, line 20 "simole" should be -simple-
Column 3, line 29 "bv" should be - by-
Column 3, line 67 "aoplied" should be -applied-
Column 4, line 13 "oarallel" should be -parallel-
Column 4, line 45 "4a in" should be -4a, in-
Column 4, line 63 "oarts" should be -parts-
Column 5, line 13 "imo-" should be -imp- -
Column 5, line 67 "veloos" should be -velops-
Column 6, line 58 "about" should be -abut-

Signed and Sealed this

Third Day of November, 1987

*Attest:*

DONALD J. QUIGG

*Attesting Officer*

*Commissioner of Patents and Trademarks*